US005632653A

United States Patent [19]

Sawada

[11] Patent Number: 5,632,653

[45] Date of Patent: May 27, 1997

[54] WATERPROOF CONNECTOR

[75] Inventor: Yoshitsugu Sawada, Shizuoka-ken, Japan

[73] Assignee: Yazaki Corporation, Tokyo, Japan

[21] Appl. No.: 627,279

[22] Filed: Apr. 4, 1996

[30] Foreign Application Priority Data

Apr. 6, 1995 [JP] Japan ..... 7-081304

[51] Int. Cl.[6] ..... H01R 13/40

[52] U.S. Cl. ..... 439/587; 439/279

[58] Field of Search ..... 439/587, 589, 439/274, 275, 279

[56] References Cited

U.S. PATENT DOCUMENTS

| | | | |
|---|---|---|---|
| 5,145,410 | 9/1992 | Maejima et al. | 439/587 |
| 5,151,045 | 9/1992 | Cravens et al. | 439/271 |
| 5,240,433 | 8/1993 | Kato | 439/279 |
| 5,266,045 | 11/1993 | Yamamoto et al. | 439/275 |
| 5,306,195 | 4/1994 | Hayashi | 439/587 |

FOREIGN PATENT DOCUMENTS

| | | |
|---|---|---|
| 5-205810 | 8/1993 | Japan . |
| 2127628 | 4/1984 | United Kingdom . |

*Primary Examiner*—Neil Abrams
*Assistant Examiner*—Barry Matthew L. Standig
*Attorney, Agent, or Firm*—Finnegan, Henderson, Farabow, Garrett & Dunner, L.L.P.

[57] ABSTRACT

A waterproof connector having a housing including terminal accommodation chambers for accommodating metal terminals connected to ends of electric wires, a waterproof cap disposed at the rear end of the housing, through which the electric wires are drawn, and having electric-wire insertion openings through which the drawn electric wires are inserted in such a manner that the electric wires are in close contact with one another, and a waterproof-cap holder for holding the waterproof cap together with the housing to mount the waterproof cap on the rear end thereof and having electric-wire drawing openings through which the electric wires inserted through the electric-wire insertion openings are drawn, wherein the waterproof-cap holder has a water-discharge-space forming member for forming a space for discharging, to the outside of the waterproof connector, water introduced into a space between the waterproof-cap holder and the waterproof cap through the electric-wire drawing openings, the space being formed between the waterproof-cap holder and the waterproof cap by the water-discharge-space forming means.

3 Claims, 3 Drawing Sheets

WATERPROOF CONNECTOR

BACKGROUND OF THE INVENTION

1. Field of the Invention

The present invention relates to a waterproof connector having a waterproof cap for proofing, against water, inside portions of terminal accommodation chambers formed in a housing such that the waterproof cap is held between the rear end of the waterproof connector and a waterproof-cap holder.

2. Description of the Related Art

A conventional waterproof connector has been disclosed in Japanese Patent Laid-Open No. 5-205810. The foregoing waterproof connector consists of a housing including a plurality of terminal accommodation chambers, spacers for preventing separation of metal terminals accommodated in the terminal accommodation chambers, a waterproof cap to be mounted on the rear end of the housing from which the electric wires are drawn, and a waterproof-cap holder to be secured to the rear end of the housing so as to secure the waterproof cap to the rear end of the housing.

The plural terminal accommodation chambers formed in the housing are located adjacent to one another. The waterproof cap has a plurality of electric-wire insertion openings to correspond to the terminal accommodation chambers, the electric-wire insertion openings being formed such that the electric wires, each having an end to which the metal terminal is connected, are inserted into the electric-wire insertion openings while being in close contact with one another. Also the waterproof-cap holder for holding the waterproof cap together with the rear end of the housing has a plurality of electric-wire drawing openings to correspond to the terminal accommodation chambers.

The waterproof connector is assembled in such a manner that the waterproof cap is located at the rear end of the housing, and then the waterproof-cap holder is secured to the rear end of the housing. Thus, the waterproof cap is held between the waterproof-cap holder and the rear end of the housing. In the foregoing state, the openings in the rear end portions of the terminal accommodation chambers respectively are allowed to communicate with the electric-wire insertion openings of the waterproof cap. Moreover, the openings in the rear end portion of the waterproof cap respectively are allowed to communicate with the electric-wire drawing openings of the waterproof-cap holder.

Then, the metal terminals connected to the ends of the electric wires are inserted into the terminal accommodation chambers through the rear end of the housing. After all of the metal terminals have been accommodated in the terminal accommodation chambers, the spacers are inserted into the terminal accommodation chambers through the front surface of the housing to prevent separation of the metal terminals from the terminal accommodation chambers. As a result, the spaces in the terminal accommodation chambers can reliably be proofed against water due to the waterproof cap attached to the rear end openings of the terminal accommodation chambers.

However, each of the electric-wire drawing openings of the waterproof-cap holder is formed to have a diameter larger than the outer diameter of the electric wire in order to easily insert the electric wire. Therefore, a gap is undesirably formed between the electric-wire drawing opening and the electric wire. As a result, water can easily be accumulated in the foregoing gap. If the waterproof connector is allowed to stand for a long time in the state where water has been accumulated in the gap, water will undesirably be introduced into the terminal accommodation chambers through the gaps among the waterproof cap and the outer surfaces of the electric wires. Thus, there is a possibility that problems, such as defective conduction of the metal terminal, might take place.

SUMMARY OF THE INVENTION

Accordingly, an object of the present invention is to provide a waterproof connector which is capable of preventing accumulation of water in gaps among electric-wire drawing openings of a waterproof-cap holder and electric wires, and which can, therefore, be proofed against water.

In order to achieve the foregoing object, according to one aspect of the present invention, there is provided a waterproof connector comprising: a housing including terminal accommodation chambers for accommodating metal terminals connected to ends of electric wires; a waterproof cap disposed at the rear end of the housing, through which the electric wires are drawn, and having electric-wire insertion openings through which the drawn electric wires are inserted in such a manner that the electric wires are in close contact with one another; and a waterproof-cap holder for holding the waterproof cap together with the housing to mount the waterproof cap on the rear end thereof and having electric-wire drawing openings through which the electric wires inserted through the electric-wire insertion openings are drawn, wherein the waterproof-cap holder has water-discharge-space forming means for forming a space for discharging, to the outside of the waterproof connector, water introduced into a space between the waterproof-cap holder and the waterproof cap through the electric-wire drawing openings, the space being formed between the waterproof-cap holder and the waterproof cap by the water-discharge-space forming means.

According to another aspect of the present invention, there is provided a waterproof connector according to the foregoing aspect of the present invention, wherein the water-discharge-space forming means has a plurality of projections projecting over the peripheries of the electric-wire drawing openings adjacent to the waterproof cap so as to press the waterproof cap against the rear end of the housing, and discharge grooves each of which is formed between the projections to discharge, to the outside of the waterproof connector, water introduced into a space between the waterproof-cap holder and the waterproof cap.

According to another aspect of the present invention, there is provided a waterproof connector according to the first aspect of the present invention, wherein the water-discharge-space forming means consists of projections formed among adjacent electric-wire drawing openings.

According to the present invention, the space formed between the waterproof cap and the waterproof-cap holder by the water-discharge-space forming means causes water introduced through the electric-wire drawing openings of the waterproof-cap holder to be allowed to flow into the foregoing space and then discharged through the space between the waterproof-cap holder and the housing.

According to the present invention, the waterproof cap held between the rear end of the housing and the waterproof-cap holder is pressed against the rear end of the housing by the plural projections. Since the space is formed between the waterproof-cap holder and the waterproof cap due to the foregoing projections, water introduced through the electric-wire drawing openings is allowed to flow into the foregoing space through the discharge grooves and then discharged.

According to the present invention, the projections formed among the electric-wire drawing openings form the space between the waterproof-cap holder and the waterproof cap mounted on the rear end of the housing with the waterproof-cap holder. Thus, water introduced through the electric-wire drawing openings can be allowed to flow into the foregoing space and then discharged.

Other objects, features and advantages of the invention will be evident from the following detailed description of the preferred embodiments described in conjunction with the attached drawings.

DESCRIPTION OF THE PREFERRED EMBODIMENTS

Figure 1:
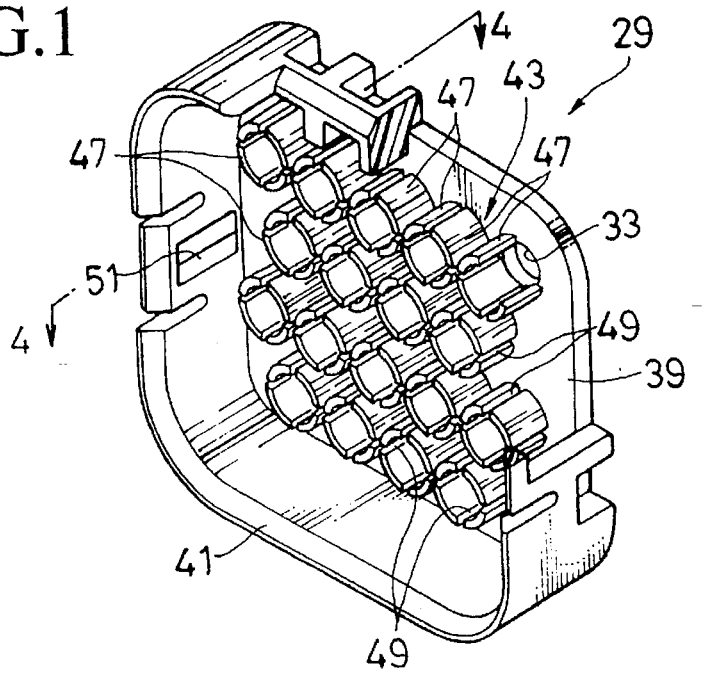
FIG. 1 is a perspective view showing a waterproof-cap holder of a waterproof connector according to the present invention.
Figure 2:
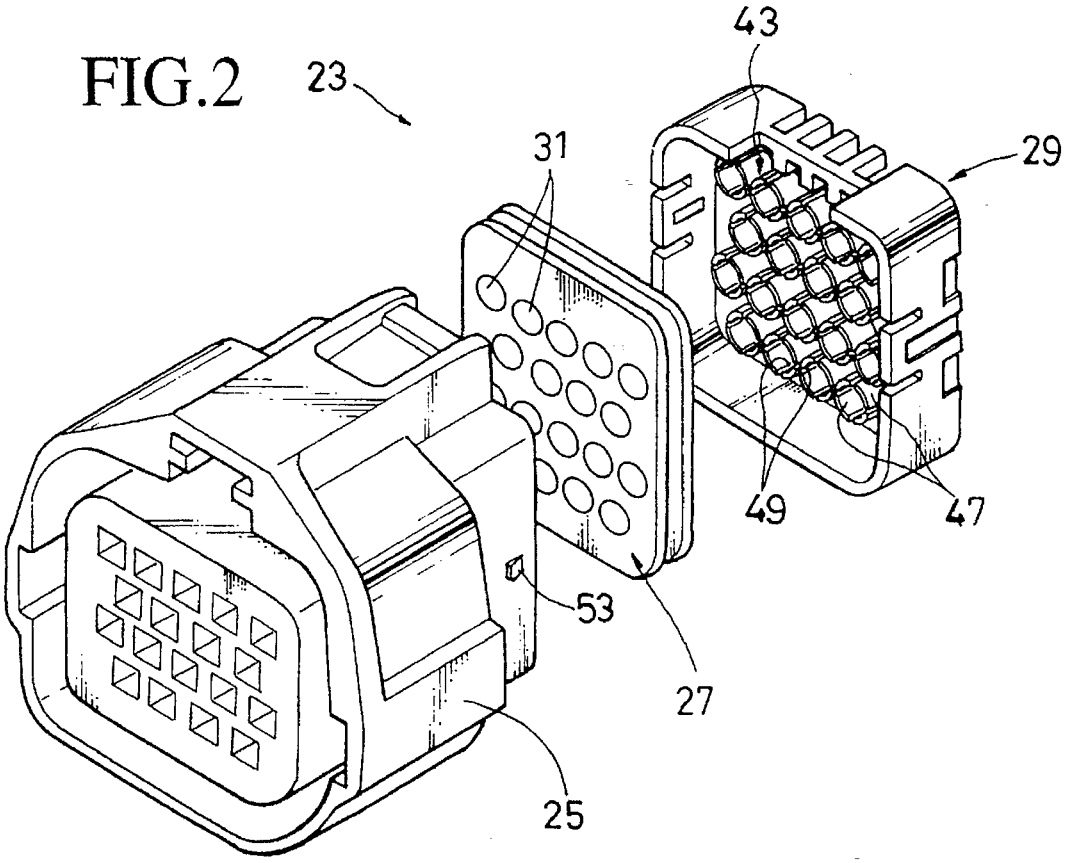
FIG. 2 is a perspective view showing the waterproof connector according to the present invention.
Figure 3:
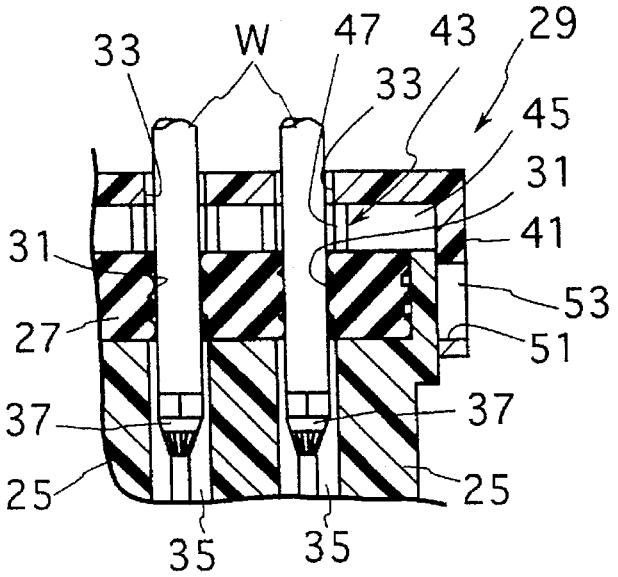
FIG. 3 is a cross sectional view showing the relationship among a housing, a waterproof cap and the waterproof-cap holder of the waterproof connector according to the present invention.
Figure 4:
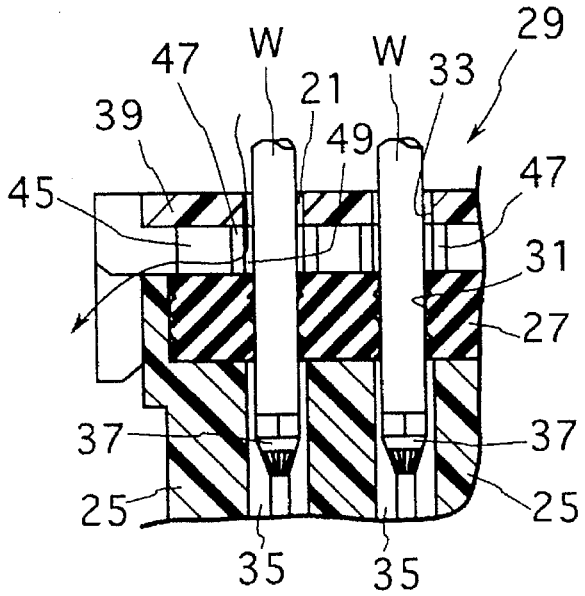
FIG. 4 is a partial cross sectional view taken along line 4—4 shown in FIG. 1.
Figure 5:
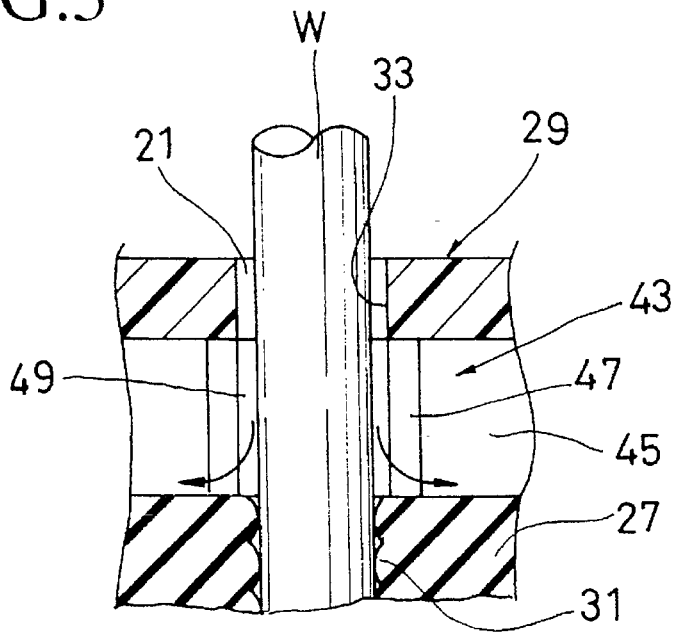
FIG. 5 is an enlarged cross sectional view showing a portion of FIG. 3.
Figure 6:
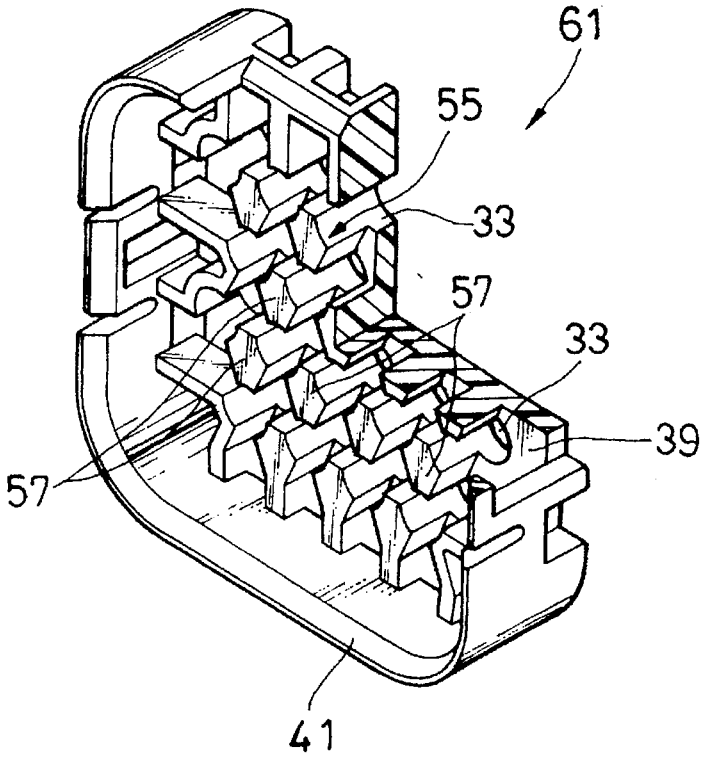
FIG. 6 is a perspective view showing a waterproof connector and a waterproof-cap holder of a waterproof connector according to another embodiment of the present invention.

Preferred embodiments of the present invention will now be described with reference to the drawings. FIG. 1 is a perspective view showing a waterproof-cap holder 29 for mounting a waterproof cap 27 on a housing 25 of a waterproof connector 23. FIG. 2 is an exploded perspective view showing the waterproof connector 23. FIG. 3 is a cross sectional view showing the relationship between the waterproof cap 27 and the waterproof-cap holder 29. FIG. 4 is a partial cross sectional view taken along line 4—4 shown in FIG. 1. FIG. 5 is an enlarged cross sectional view showing a portion of FIG. 4.

As shown in FIG. 2, the waterproof connector 23 has the housing 25 and the waterproof cap 27 disposed at the rear end of the housing 25 through which electric wires W are drawn, the waterproof cap 27 having electric-wire insertion openings 31, through which the electric wires W are inserted in such a manner that the electric wires W are brought into close contact with one another. Moreover, the waterproof connector 23 has the waterproof-cap holder 29 for, together with the housing 25, holding the waterproof cap 27 so as to mount the waterproof cap 27 on the rear end thereof, the waterproof-cap holder 29 having electric-wire drawing openings 33 through which the electric wires W are drawn.

As shown in FIG. 3, the housing 25 has a plurality of terminal accommodation chambers 35 therein. Each of the terminal accommodation chambers 35 accommodates a metal terminal 37 connected to ends of the electric wires W.

The waterproof cap 27 is made of rubber and thus having elasticity to permit the electric wires W, each having the metal terminal 37 connected to the ends thereof, to be inserted into the electric-wire insertion openings 31 in such a manner that the electric wires W are in close contact with one another.

As shown in FIG. 1, the waterproof-cap holder 29 consists of a base portion 39 and a peripheral wall 41 formed to surround the base portion 39. The base portion 39 has the electric-wire drawing openings 33 which are allowed to communicate with the electric-wire insertion openings 31 of the waterproof cap 27. Moreover, the waterproof-cap holder 29 has a water-discharge-space forming means 43. The water-discharge-space forming means 43 forms a space 45 (see FIGS. 3, 4 and 5) for discharging water introduced through the electric-wire drawing openings 33 into the space between the waterproof-cap holder 29 and the waterproof cap 27, the space 45 being formed between the waterproof-cap holder 29 and the waterproof cap 27.

The water-discharge-space forming means 43 consists of projections 47 formed to project over portions around the electric-wire drawing openings 33 toward the waterproof cap 27 of the electric-wire drawing openings 33; and discharge grooves 49 each of which is formed between the projections 47 so as to discharge water introduced between the waterproof-cap holder 29 and the waterproof cap 27.

The peripheral wall 41 has securing holes 51 so as to receive securing projections 53 projecting over the outer surface of the housing 25 so that the waterproof-cap holder 29 is secured to the housing 25.

The waterproof connector 23 is assembled in such a manner that the waterproof-cap holder 29 is secured to the housing 25 in the state where the waterproof cap 27 is located at the rear end of the housing 25. In this case, the securing projections 53 of the housing 25 are received within the securing holes 51 of the waterproof-cap holder 29 so that the waterproof-cap holder 29 is secured to the housing 25. In the foregoing state, the waterproof cap 27 is pressed against the rear end of the housing 25 by the projections 47. The space 45 is formed between the waterproof-cap holder 29 and the waterproof cap 27. Then, the metal terminals 37 attached to the ends of the electric wires W are inserted through the electric-wire drawing openings 33, followed by inserting the metal terminals 37 into the electric-wire insertion openings 31 of the waterproof cap 27 so as to be accommodated in the terminal accommodation chambers 35.

According to this embodiment, as described above, having the space 45 between the waterproof cap 27 and the waterproof-cap holder 29, water introduced through the electric-wire drawing openings 33 of the waterproof-cap holder 29 can be allowed to flow into the discharge grooves 49. Then, water flows into the space 45 so that water is, to the outside of the waterproof connector 23, discharged through the space between waterproof-cap holder 29 and the housing 25. As a result, water cannot be accumulated in gaps 21 among the electric-wire drawing openings 33 and the electric wires W. Thus, the waterproof connector 23 can reliably be proofed against water.

Another embodiment of the present invention will now be described with reference to FIG. 5. A water-discharge-space forming means 55 according to this embodiment consists of projections 57 formed among the adjacent electric-wire drawing openings 33 of a waterproof-cap holder 61. As shown in FIG. 5, the projections 57 are formed among the electric-wire drawing openings 33, the projections 57 pressing the waterproof cap 27 against the rear end of the housing 25 in the state where the waterproof cap 27 has been mounted on the rear end of the housing 25. Moreover, the water-discharge-space forming means 55 forms a space 59 between the waterproof cap 27 and the waterproof-cap holder 61.

According to this embodiment, water introduced through the spaces among the electric-wire drawing openings 33 and the electric wires W is allowed to flow from the spaces among the projections 57 into the spaces 59. Then, water is discharged through the gap between the waterproof-cap holder 61 and the housing 25. Therefore, water cannot be accumulated among the electric-wire drawing openings 33 and the electric wires W. Thus, water cannot be introduced into the terminal accommodation chambers 35 through the gaps among the electric-wire insertion openings 31 of the waterproof cap 27 and the electric wires W. As a result, the waterproof connector 23 can reliably be proofed against water.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A waterproof connector comprising:

a housing including terminal accommodation chambers for accommodating metal terminals connected to ends of electric wires;

a waterproof cap disposed at the rear end of said housing, through which the electric wires are drawn, and having electric-wire insertion openings through which the drawn electric wires are inserted in such a manner that the electric wires are in close contact with one another; and a waterproof-cap holder for holding said waterproof cap together with said housing to mount said waterproof cap on the rear end thereof and having electric-wire drawing openings through which the electric wires inserted through the electric-wire insertion openings are drawn, wherein said waterproof-cap holder has water-discharge-space forming means for forming a space for discharging, to the outside of said waterproof connector, water introduced into a space between said waterproof-cap holder and said waterproof cap through said electric-wire drawing openings, said space being formed between said waterproof-cap holder and said waterproof cap by said water-discharge-space forming means.

2. A waterproof connector according to claim 1, wherein said water-discharge-space forming means has a plurality of projections projecting over the peripheries of said electric-wire drawing openings adjacent to said waterproof cap so as to press said waterproof cap against the rear end of said housing, and discharge grooves each of which is formed between said projections to discharge, to the outside of said waterproof connector, water introduced into the space between said waterproof-cap holder and said waterproof cap.

3. A waterproof connector according to claim 1, wherein said water-discharge-space forming means consists of projections formed among adjacent electric-wire drawing openings.

* * * * *